United States Patent [19]

Kruger

[11] 4,122,619

[45] Oct. 31, 1978

[54] MICROFILM-UNIT AND MAGNIFYING-GLASS LOCKET

[75] Inventor: Bernard M. Kruger, West Caldwell, N.J.

[73] Assignee: Arnold Herman, Warren, N.J.

[21] Appl. No.: 834,898

[22] Filed: Sep. 20, 1977

[51] Int. Cl.[2] ..... G09F 11/30

[52] U.S. Cl. ..... 40/365; 63/18

[58] Field of Search ..... 40/152, 152.1, 158, 40/10 D, 361–366; 350/92, 235, 241, 252, 257; 63/20

[56] References Cited

U.S. PATENT DOCUMENTS

| | | | |
|---|---|---|---|
| 912,329 | 2/1909 | Sterrick | 40/154 |
| 2,506,509 | 5/1950 | Kratkowski | 40/152 |
| 3,178,842 | 4/1965 | Zimmerman | 40/10 R |
| 3,180,042 | 4/1965 | Destal | 40/10 D |

*Primary Examiner*—Louis G. Mancene
*Assistant Examiner*—Wenceslao J. Contreras

[57] ABSTRACT

In a preferred embodiment, a locket portably suitable to be worn on a chain or cord around a person's neck, opens as a base and lid, of which the base supports the pivotally opening lid and also from within space thereof a microfilm support carrying removable, replaceable and disposable transparent plastic-encased microfilm viewable in magnification through a replaceable plastic magnifying glass wedge-mounted in the wall of the lid, the microfilm support being a short frame circumscribing a through space across which the microfilm is mounted, the microfilm transparent casing being stepped at its base and being mounted slidably into an insertion-slot space, and the frame being inexpensively a single structure formed into a hinge and mounting slot spring-biased outwardly to a viewing state and position from a compacted collapsed storage position down-position at which the lid is closed upon the base to form enclosure space storing the microfilm mounted on the microfilm support.

7 Claims, 4 Drawing Figures

MICROFILM-UNIT AND MAGNIFYING-GLASS LOCKET

This invention relates to a locket for carrying and viewing a microfilm embodying medical information about the person wearing the locket.

BACKGROUND TO THE INVENTION

Prior to the present invention, there have been many instances in which during medical emergency situations, lack of knowledge of the medical history of a person in need of treatment and unable to convey information because of unconsciousness or other major injury, resulted in the erroneous and harmful treatment of the of the person allergic to some drug, and/or in need of some drug such as insulin for the diabetic person, or digitalis for a person of heart-failure indications, and the like. Until recent technology making possible the inclusion of typically an entire medical record upon a single microfilm frame, it has not been possible to include more than a mere minor amount of selected information within a small space available for easy reading thereof. Moreover, heretofore, there have been only very special situations in which microfilm might be utilized and with very specialized handling equipment because of the fact that any handling and touching of a microfilm-face results in immediate destruction of the transcribed material and data thereon, whereby such has been totally unsuitable and not utilizable in situations devoid of convention business machine-handling equipment, together with special storage microfilm envelops. Accordingly, microfilms are sensitive to body moisture of prespiration and touch which cause immediate deterioration of the transcribed data, and magnifying glasses become quickly scratched and marred and impossible thereafter to adequately see through, much less able to discern written matter transcribed thereon. While prior lockets have existed for the migification and reading of locket-included information — as in the Gould patents: U.S. Pat. Nos. 302,722 of 1884; 277,022 of 1883; 296,741 of 1884; and also the U.S. Pat. No. 3,178,842; such structures for reasons stated above, could not possibly be utilized for a microfilm, much less where the microfilm is to be periodically intermittently withdrawn and replaced, requiring the handling thereof, aside from the corrosive effects of body moisture and other dirt and trash that collect in a worn portable locket. Also such prior structures could not be of commercial practicality because of the involved structures thereof as well as other problems by which it would be impossible to utilize microfilm with such structures.

SUMMARY OF THE INVENTION

Accordingly, objects of the present invention include the overcoming and/or avoiding of porblems and difficulties of the types discussed above, together with providing needed functions and novel advantages not heretofore available.

In particular, an object is to provide a disposable but durable microfilm unit and a microfilm unit holder adapted for sturdy support and simple quick insertion or removal of the same, while providing for easy and inexpensive manufacture of the holder of the microfilm unit, to make thereby such microfilm locket commercially feasible and economically practical.

Another object is to provide for mounting and transport of mounted microfilm for ready-reading of the same, while concurrently providing for protection of sensitive surfaces of the same against corrosive moisture, handling and/or wearing environmental conditions and surroundings above-noted.

Another object is to provide a locket microfilm mount which is devoid of light-defracting glass, plastic or other transparent support structure, other than noted hereinafter, together with avoiding light-blocking inherent structures disadvantageous particularly when soiled and/or old and the like.

Another object is to provide a mount for a removable and replaceable magnifying glass for a replaceable microfilm unit, for a collapsible combination providing for easy transport and frequent up-dating with new-data microfilm, together with rapid availability and speedy reading readiness as a result of exact focal length being always maintainted by the novel microfilm unit and holder therefor, when opened to a viewing and reading state and position.

Another object is to obtain one or more of the objects, together with easy access and opening to the viewing and reading state and position.

Other objects become apparent from the preceding and following disclosure.

One and more objects are obtained by embodiments illustrated hereinafter as merely typical of the broader sope to which the invention is entitled, the illustrated embodiments being intended to enhance ready understanding of the invention.

Broadly the invention may be described as a novel locket combination embodying a novel microfilm mounting structure having novel transparent plastic structure encasing data-carrying microfilm mounted therein viewable in an extended or open state, with novel structure and mechanism for mounting and transporting portably the plastic-encased microfilm, together with an also locket-transported magnifying glass and locket, mounted as a part of the locket, in which the improvement broadly speaking, resides in the transparent plastic-encased microfilm, utilizing clear plastic through which the data is clearly discernible, and a novel microfilm mounting structure being of a shape forming an edge-slot receivable of an edge of the microfilm plastic casing to be slipped into and supported within a slot space by the structure of and forming the slot, positioned for viewing through the magnifying glass and the plastic casing.

In various preferred embodiments thereof, the base of the plastic casing is stepped and the slotted space is provided by a holder providing bottom and lateral support to the stepped base, when mounted in the state and position for viewing the microfilm data carried by the microfilm.

A major and preferred novel feature of the invention is the holder, above-referred to as the microfilm mounting structure, in which the holder includes structure shaped to form a shallow receptacle, the receptacle walls of which provide upright support to the lateral faces of the step received in the shallow receptacle, and which also provides seating support to bottom face of the transverse (horizontal) wall of the step — as viewed when the microfilm casing is on-edge in its upright viewable position above-discussed.

A further major improvement and preferred embodiment is the novel plastic magnifying glass having structure of typically a step typically extending around the periphery thereof, whereby a base of the magnifying glass is of reduced (lesser) diameter as compared to the top or front (exterior, when the locket is closed) of the magnifying glass, such that the reduced portion is wedgably-fitted into a receiving aperature, and is thereby removable periodically whenever the face of the magnifying glass becomes scratched or otherwise abused — as normally is the case. The wedge snap-in feature of this plastic magnifying glass as above-described, provides for easy and convenient replacement by the locket owner and wearer. Thus, the plastic magnifying glass is removably insertable into an aperature formed in the face of the locket lid which folds-down to thereby enclose the already folded-down mounted plastic casing encasing the microfilm.

Because the contemplated typical and suggested way of normal carrying of the locket is by way of a chain, cord or strap or the like, normally hung around the neck in the nature of a locket and chain, the exterior of the locket will be exposed to body perspiration and rubbing against the body and/or clothing, and to normal handling typical of any locket, and to atmospheric conditions together with filth of the atmosphere and objects in contact with the locket from time to time. Accordingly, in a further embodiment also preferred as an improvement over what was heretofore available, and important to the commercial feasibility and practicality both cost-wise of the material and normally prior plurality of parts, and prior labor costs of assemblage thereof, the present holder of the plastic casing (having the microfilm enclosed therein), is a unitary structure — i.e. a singlely cut or formed piece, bent or formed to both provide the structure above-described for receiving the plastic casing as well as being structured, shaped, preformed or subsequently formable to enclose or encase a spring and shaft having the spring connected between each of the shaft and the encasement, with the shaft extending from each of opposite ends of the through-space formed by the encasing structure thereof, and with at least one end of the shaft having an irregular shape or cross-section or its equivalent as to prevent the shaft from turning in a hole (aperature) in the casing (locket) side; however, alternately, it would be equivalent to permit the shaft to turn, and to have the spring anchored to the casing instead of anchored to the shaft. However, the present structure is preferred as more easily assembled and at lower costs, as well as being more dependable and durable.

Also preferred is an extension of the lid (which embodies the magnifying glass in the aperature centered in the lid), which extension extends beyond the normal base receptable/casing. The extension not only provides a ready-handle for easy manipulation in opening the locket, but has the preferred feature of an edge (or perhaps both edges) of the lateral portion of the extension structured (shaped) and positioned as to be wedgable, in a closed fastened state, against locket base-casing receptacle structure such that it serves as a latching mechanism for holding in the closed state the closed lid, until purposely opened manually by releasing against the wedged state, after which preferably a spring thereafter fully opens the lid to the erect upright position and maintain the lid there until intentionally manually closed; when the lid is thus opened, the spring-biased holder of the plastic casing springs-up to its ready, upright and readable position until thereafter manually closed prior to closing the lid thereover.

The invention may be better understood by making reference to the figures, descriptions thereof to follow.

THE FIGURES

DETAILED DESCRIPTION

Figure 1:
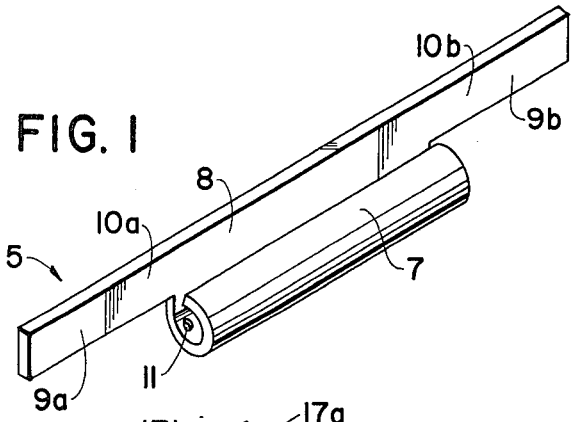
FIG. 1 illustrates in perspective side view the preferred unitary structure of both the holder of the plastic transparent casing and the spring and shaft-enclosing structure, with the spring and shaft-enclosing structure being in already the enveloping shape, but the holder structure being still in an extended uncompleted form.

In greater detail, all of FIGS. 1 through 4 illustrated a common embodiment of a locket 22 having a base receptacle structure as a mounting-base, 23 with decorative mounted-disk 24, and mounted lid as the frame 32 with its aperature 39 which receives the reduced-diameter step-structure insert 35 of the plastic magnifying glass (lense) 33 with front, exterior portion 34 and lateral step-wall 36 and step bottom wall 37, and composition (cross-section interior) 38 of transparent plastic, and the mounted holder 5 and plastic casing 16 mounted therein.

Figure 2:
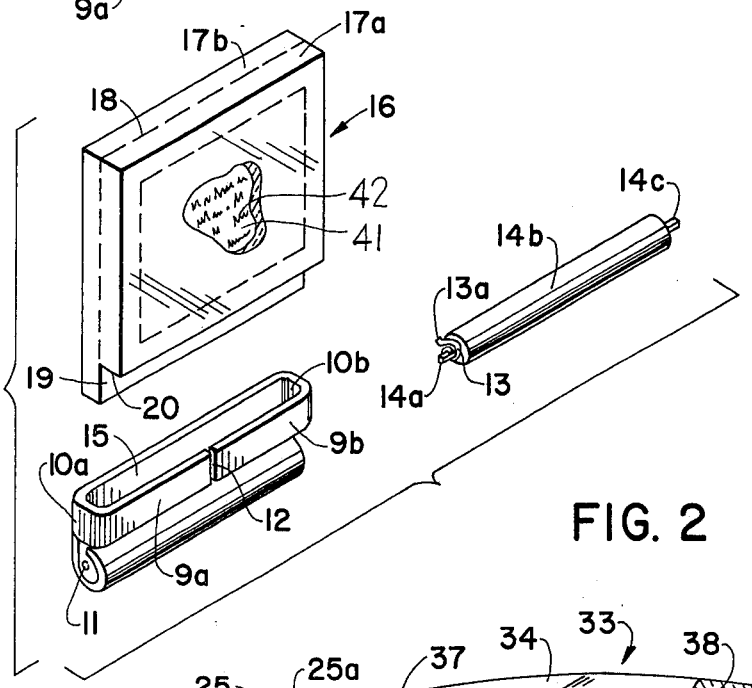
FIG. 2 illustrates in perspective side view, in an exploded view thereof, the completed structure of FIG. 1, together with other assemblage elements such as the shaft and spring, and the microfilm-encasing plastic transparent casing shown with a cut-away portion disclosing the encased microfilm having informational data thereon.

A major feature of the present invention is the preferred stepped shape of the plastic casing 16, together with the holder 5 as shown in the completed state in FIG. 2. As can be seen in the Figure illustration, the plastic casing 16 has the forward and rearward faces of fused plastic sections **17*a* and 17*b* are parallel with one-another; this serves to improve the stepped base-mounting thereof as well as avoiding the reflection or distortion of light rays striking and/or passing therethrough, the illustrated plastic casing having an illustrative cut-away in the forward face in which for illustrative purposes the microfilm 41 having informational data 42 is viewable in the FIG. 2. The plastic casing side-step (lateral) wall 19 is supported by the inner face of supporting wall portion 9*a* and the opposite supporting wall portion 9*b*, and the supporting wall portions 10*a*/*b*. As can be seen from FIGS. 1 and 2, the wall portions 9*a* and 9*b* are formed into position by bends (bend portions) 10*a* and 10*b*, to thereby form the receptacle 15. Central wall portion 8 supports a rearward face of the plastic casing in the inserted mounted state of the plastic casing. Aperature 11 serves as an anchor hole for the spring end 13*a* of spring 13 mounted on the squared shaft end 14*a* of shaft structure 14*b* having also squared shaft end 14*c* at the other and opposite end. The shaft structure 14*b* in the mounted state fits within the through open-ended passage formed by the encasing structure 7. Thus, the receptacle 15 receives the insertion small stepped part of the plastic casing, and in the seated state the overhanging step-bottom 20 overhangs and is supported by the wall portions 9a and 9b, by the upper edges thereof. The formed wall portions 9a and 9b substantially meet at point 12**, and are aligned end to end in parallel arrangement to each other.

Figure 4:
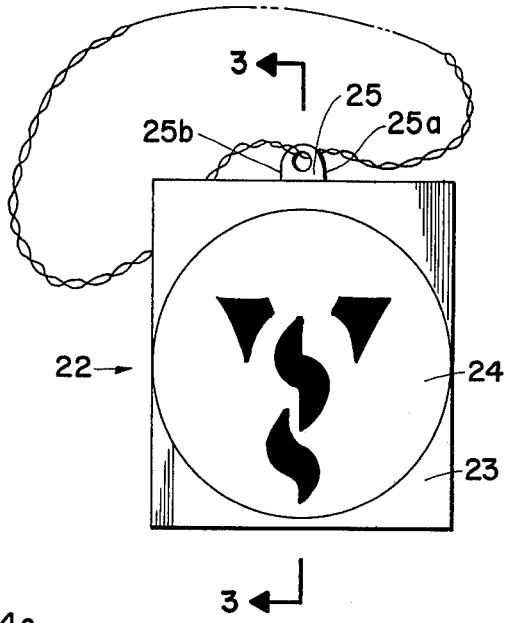
FIG. 4 illustrates an elevation plan view of a typically appearing locket of the present invention, in a closed state.
Figure 3:
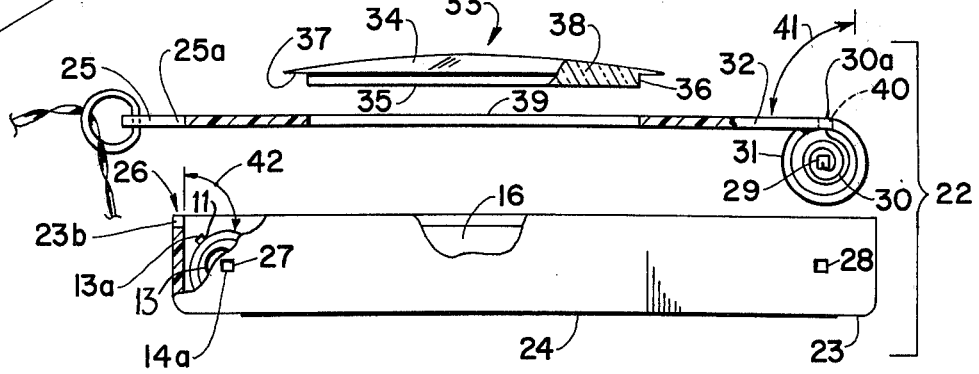
FIG. 3 illustrates a side and exploded view of the locket of FIG. 4, and further illustrates some of the mounting features of the elements illustrated in FIGS. 1 and 2, as well as illustrating other additional features such as the lid structures and latching mechanism thereof and the plastic magnifying glass and its mounting mechanism.

The FIGS. 3 and 4 illustrations have illustrated the handle extension 25 having opposite lateral edges 25a and 25b which are spaced-apart (for width of extension 25) sufficiently for each to wedge against opposite edges of a cut-out in the casing wall, of which the edge 23b is illustrated in FIG. 2 for the cut-out 26 into which the handle extension 25 is wedgably seated in the lid-closed state.

The shaft end 14a is anchored in squared hole 27 of the side wall of mounting base receptacle, mounting base 23. The spring 13 biases the plastic casing 16 shown in the closed (down) position in FIG. 3, becomes erect (upright) by the spring-biasing action, moving in opposite directions 42.

The FIG. 2 illustration also shows the spring 30 mounted within an encasing structure 31, anchored by spring end 30a within anchor hole 40 and attached to shaft-end 29 of squared cross-section, which shaft-end 29 fits into squared hole 28.

The lid structure (frame 32) pivots from the illustrated horizontal to an upright position along directions 41.

It is within the scope of the invention to make variations and modifications and substitution of equivalents as are apparent to a person of ordinary skill in the art.

I claim:

1. A microfilm-locket device comprising in combination: a portable fold-down locket adapted for transporting microfilm mounted therein including a mounting-base structure, and including fold-down magnifying glass means adapted for optically viewing in magnification a microfilm mounted by the locket means, as a unit; the improvement comprising a microfilm encased within transparent plastic casing, and holder means mounted on the mounting-base for retainable-insertion of and supporting of the transparent plastic casing in a state and position viewable of the microfilm therein, adapted such that microfilm is protected and disposable, and said film and forward and rearward walls of the plastic casing extending in substantially parallel planes, and said casing including a step at its base, stepping from a smaller thickness of the step mountable within the frame means having a transverse wall of the step serving as a seating-abutment preventing further insertion into the frame means and providing a stabilizing support maintaining proper alignment of the microfilm with a viewing axis of the magnifying glass, when mounted within the frame means.

2. A microfilm-locket device of claim 1, in which the frame means comprises a shallow receptacle, the receptacle walls of which provide upright support to the step received therein, upper wall surfaces of the receptacle walls providing seating support to the transverse wall of the step.

3. A microfilm-locket device of claim 2, in which the frame means includes a hinge portion and spring structure-support, the hinge portion being mounted pivotally within said mounting-base structure and said spring being mounted between each of and on the hinge portion and mounting-base structure.

4. A microfilm-locket device of claim 3, in which improvement further comprises the magnifying glass means including a frame structure having a through-aperature therethrough, and a magnifying glass having a step structure formed along a periphery thereof to a smaller predetermined breadth dimension adapted for removably wedging into said through-aperature retainably, such that the magnifying glass is intermittently replaceable.

5. A microfilm-locket device of claim 4, in which said magnifying glass is composed of plastic.

6. A microfilm-locket device of claim 1, in which improvement further comprises the magnifying glass means including a frame structure having a through-aperature therethrough, and a magnifying glass having a step structure formed along a periphery thereof to a smaller predetermined breadth dimension adapted for removably wedging into said through-aperature retainably, such that the magnifying glass in intermittently replaceable.

7. A microfilm-locket device of claim 6, in which said magnifying glass is composed of plastic.

* * * * *